US011598583B2

(12) United States Patent
Schwalm

(10) Patent No.: US 11,598,583 B2
(45) Date of Patent: Mar. 7, 2023

(54) HIGH PRESSURE COUNTERFLOW HEAT EXCHANGER

(71) Applicant: Hamilton Sundstrand Corporation, Charlotte, NC (US)

(72) Inventor: Gregory K. Schwalm, Avon, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 36 days.

(21) Appl. No.: 16/796,579

(22) Filed: Feb. 20, 2020

(65) Prior Publication Data

US 2020/0191493 A1 Jun. 18, 2020

Related U.S. Application Data

(62) Division of application No. 15/008,074, filed on Jan. 27, 2016, now Pat. No. 10,619,936.

(51) Int. Cl.
*F28D 9/00* (2006.01)
*F28F 3/02* (2006.01)
(Continued)

(52) U.S. Cl.
CPC ..... *F28D 9/0093* (2013.01); *F28D 9/0068* (2013.01); *F28F 3/025* (2013.01);
(Continued)

(58) Field of Classification Search
CPC ..... F28D 9/0093; F28D 9/0068; F28F 3/06; F28F 3/08; F28F 3/025; F28F 2250/104; F28F 2250/108
See application file for complete search history.

(56) References Cited

U.S. PATENT DOCUMENTS 2,875,986 A 3/1959 Holm
3,983,191 A 9/1976 Schauls
(Continued)

FOREIGN PATENT DOCUMENTS

FR 2809805 A1 12/2001
GB 1205933 A 9/1970
JP H07180985 A 7/1995

OTHER PUBLICATIONS

Extended European Search Report dated Jun. 7, 2017, issued during the prosecution of corresponding European Patent Application No. EP 17153316.9 (6 pages).

*Primary Examiner* — Gordon A Jones
(74) *Attorney, Agent, or Firm* — Locke Lord LLP; Scott D. Wofsy; Michael J. Pollack

(57) ABSTRACT

A heat exchanger including a plurality of heat exchanger plates in a stacked arrangement. At least two counterflow sections are positioned adjacent each other. The counterflow sections comprise an intermediate section of each heat exchanger plate. The heat exchanger plates configured to transfer heat between a first fluid and a second fluid flowing in an opposite directions from the first fluid through a respective heat exchanger plate. At least one tent section is positioned on each end of each counterflow section. The tent sections are configured to angle the flow direction of the first and second fluids in the tent sections relative to the flow direction in the counterflow sections. A wall is positioned between each tent section and each counterflow section configured to provide a load path at opposite ends of the heat exchanger to oppose forces due to pressure on the tent sections.

15 Claims, 4 Drawing Sheets

(51) Int. Cl.
*F28F 3/06* (2006.01)
*F28F 3/08* (2006.01)

(52) U.S. Cl.
CPC ..... *F28F 3/06* (2013.01); *F28F 3/08* (2013.01); *F28F 2250/104* (2013.01); *F28F 2250/108* (2013.01)

(56) References Cited

U.S. PATENT DOCUMENTS

| | | | | |
|---|---|---|---|---|
| 5,004,044 | A * | 4/1991 | Horgan | F28D 9/0012 165/145 |
| 6,510,894 | B1 * | 1/2003 | Watton | B01J 19/0013 165/166 |
| 7,328,740 | B2 | 2/2008 | Leeson et al. | |
| 7,669,643 | B2 | 3/2010 | Ekelund et al. | |
| 8,844,610 | B2 | 9/2014 | Platt | |
| 10,724,802 | B2 * | 7/2020 | Courtial | F28F 9/0265 |
| 2007/0289726 | A1 * | 12/2007 | Jibb | F25J 5/002 165/165 |
| 2017/0089643 | A1 * | 3/2017 | Arafat | F28D 9/0093 |

* cited by examiner

HIGH PRESSURE COUNTERFLOW HEAT EXCHANGER

CROSS-REFERENCE TO RELATED APPLICATION

This application claims priority to and is a divisional application of U.S. Non-Provisional application Ser. No. 15/008,074 filed on Jan. 27, 2016, and is hereby incorporated by reference.

BACKGROUND OF THE INVENTION

1. Field of the Invention

The present disclosure relates to heat exchangers, and more particularly to counterflow heat exchangers.

2. Description of Related Art

Heat exchangers such as, for example, tube-shell heat exchangers, are typically used in aerospace turbine engines. These heat exchangers are used to transfer thermal energy between two fluids without direct contact between the two fluids. In particular, a primary fluid is typically directed through a fluid passageway of the heat exchanger, while a cooling or heating fluid is brought into external contact with the fluid passageway. In this manner, heat may be conducted through walls of the fluid passageway to thereby transfer thermal energy between the two fluids. One typical application of a heat exchanger is related to an engine and involves the cooling of air drawn into the engine and/or exhausted from the engine.

Counterflow heat exchangers include layers of heat transfer elements containing hot and cold fluids in flow channels, the layers stacked one atop another in a core, with headers attached to the core, arranged such that the two fluid flows enter at different locations on the surface of the heat exchanger, with hot and cold fluids flowing in opposite directions over a substantial portion of the core. This portion of the core is referred to as the counterflow core section. A single hot and cold layer are separated, often by a parting sheet, in an assembly referred to as a plate. One or both of the layers in each plate contains a tent fin section that turns the flow at an angle relative to the direction of the flow in the counterflow fin section in the center of the plate, such that when the plates are stacked together into a heat exchanger assembly, both hot and cold fluid flows are segregated, contained and channeled into and out of the heat exchanger at different locations on the outer surface of the heat exchanger.

This counterflow arrangement optimizes heat transfer for a given amount of heat transfer surface area. However, counterflow heat exchangers require a means to allow the flow to enter and exit the counterflow portion of the heat exchanger that also segregates the hot and cold fluids at the inlets and outlets of the heat exchanger; this is typically achieved with tent fin sections at an angle relative to the counterflow core fin section. To maintain practical duct sizes to channel fluid to and from the heat exchanger, a narrow tent section width is desirable; however, because a minimum distance between fins must be maintained throughout the core and tents for structural reasons, pressure drop through the tents of a counterflow heat exchanger is often undesirably high, resulting in an undesirably large heat exchanger volume and weight.

Such conventional methods and systems have generally been considered satisfactory for their intended purpose. However, there is still a need in the art for improved heat exchangers with reduced pressure drop through the tent sections. The present disclosure provides a solution for this need.

SUMMARY OF THE INVENTION

A heat exchanger including a plurality of heat exchanger plates in a stacked arrangement. At least two counterflow sections are positioned adjacent each other. The counterflow sections comprise an intermediate section of each heat exchanger plate. The heat exchanger plates configured to transfer heat between a first fluid and a second fluid flowing in an opposite directions from the first fluid through a respective heat exchanger plate. At least one tent section is positioned on each end of each counterflow section. The tent sections are configured to angle the flow direction of the first and second fluids in the tent sections relative to the flow direction in the counterflow sections. A wall is positioned between each tent section and each counterflow section configured to provide a load path at opposite ends of the heat exchanger to oppose forces due to pressure on the tent sections.

At least two inlet ports can be configured to allow the first fluid to enter the heat exchanger and at least two outlet ports configured to allow the first fluid to exit the heat exchanger. Each inlet port and outlet port of the first fluid positioned through a respective tent. The inlet ports of the first fluid can be separated by the wall and the outlet ports of the first fluid can be separated by the wall.

At least two inlet ports can be configured to allow the second fluid to enter the heat exchanger and at least two outlet ports can be configured to allow the second fluid to exit the heat exchanger. Each inlet port and outlet port of the second fluid positioned through a respective tent. The inlet ports of the second fluid can be separated by the wall and the outlet ports of the second fluid can be separated by the wall.

The inlet ports for the first fluid can be on an opposing end of the inlet ports for the second fluid. The outlet ports for the first fluid can be on an opposing end of the outlet ports for the second fluid. The first fluid can include a cooling fluid and the second fluid can be configured to transfer heat to the first fluid within the counterflow sections.

The heat exchanger can include alternating heat exchange plates that include a cold layer with the first fluid flowing therethrough, the first fluid including a cooling fluid, the cold layer having inlet ports through respective tents at a first end and outlet ports through respective tents at a second end. The inlet ports of the first fluid are aligned facing away from each other, such that the first fluid entering from each respective inlet port is separated through the counterflow section. The heat exchanger can include alternating heat exchange plates include a hot layer with the second fluid flowing therethrough, the second fluid configured to transfer heat from the cooling fluid, the hot layer having inlet ports through respective tents at a second end and outlet ports through respective tents at a first end. The inlet ports of the second fluid are aligned facing away from each other, such that the second fluid entering from each respective inlet port is separated through the counterflow section.

At one end of the counterflow sections each tent can include a header and wherein at an opposing end of the counterflow sections, two tents share a single header separated by the wall. The heat exchanger can comprise four counterflow sections and a wall separating each counterflow section.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 2:
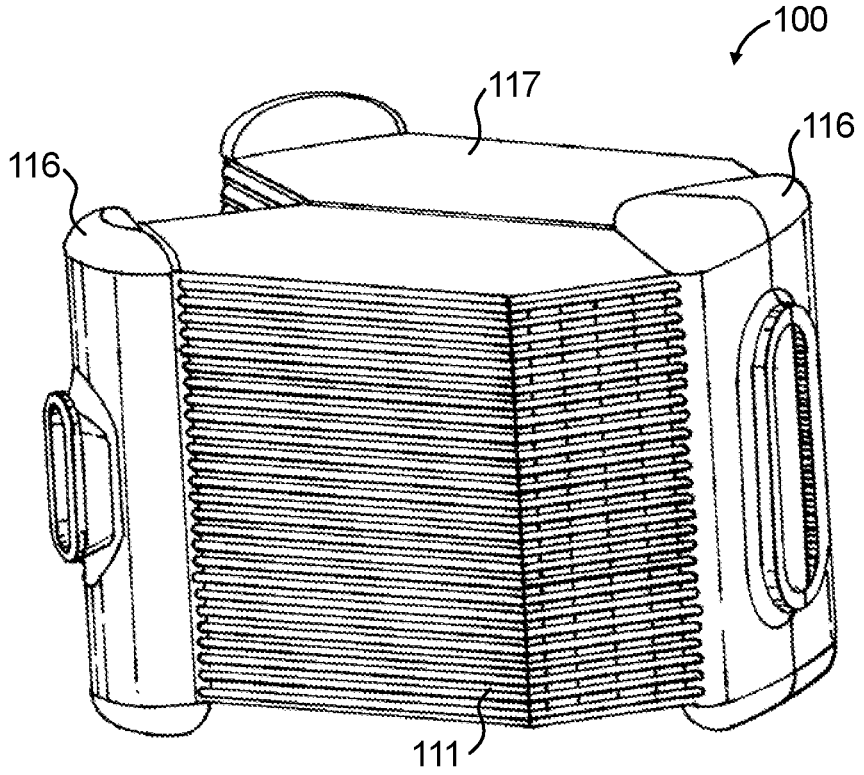
FIG. 2 is a perspective view of an exemplary embodiment of a heat exchanger constructed in accordance with the present disclosure, showing heat exchanger plates in a stacked arrangement with inlet and outlet ports.

Reference will now be made to the drawings wherein like reference numerals identify similar structural features or aspects of the subject disclosure. For purposes of explanation and illustration, and not limitation, a partial view of an exemplary embodiment of a counterflow heat exchanger in accordance with the disclosure is shown in FIG. 2 and is designated generally by reference character 100. Other embodiments of the counterflow heat exchanger in accordance with the disclosure, or aspects thereof, are provided in FIGS. 3*a*-4, as will be described.

Figure 1A:
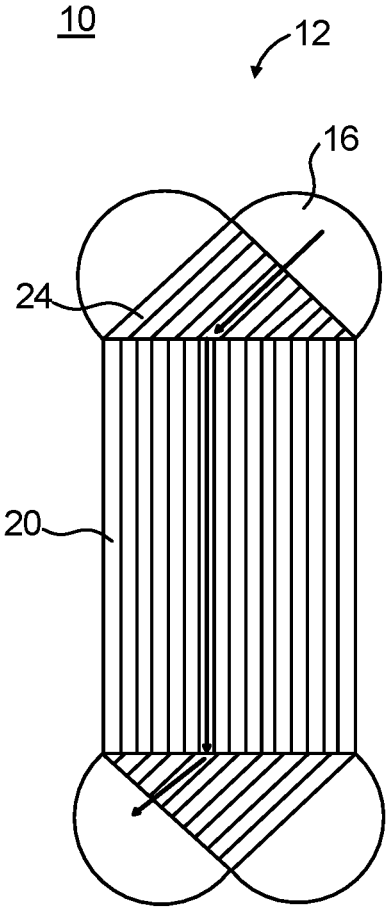
Fig. 1a (Prior Art)
FIG. 1*a* is a cross-sectional view of a heat exchanger plate of the prior art, showing a hot layer with angled tent sections.
Figure 1B:
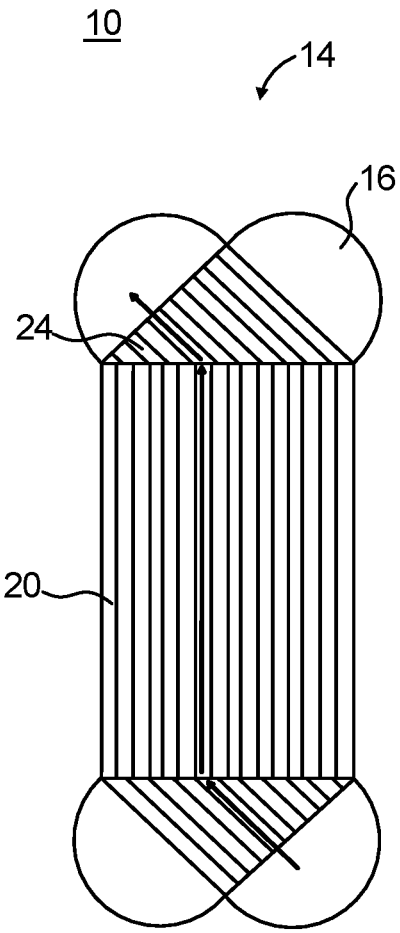
Fig. 1b (Prior Art)
FIG. 1*b* is a cross-sectional view of a heat exchanger plate of the prior art, showing a cold layer with angled tent sections.

Counterflow heat exchanger designs require tents at an angle relative to the counterflow core section to allow the flow to enter and exit the counterflow core section of the heat exchanger. The hot and cold layers of prior art design are shown in FIGS. 1*a* and 1*b*. Prior art counterflow heat exchangers include hot and cold layers 12, 14 attached to a parting sheet (not shown) that separates the hot and cold fluids. The heat exchanger is comprised of a cold layer including cold fins, a hot layer including hot fins and a parting sheet therebetween. This assembly is stacked one atop another to form a core with headers 16 attached to the core and arranged such that a cooling fluid enters at one end while a hot fluid enters on an opposing end, while allowing the hot and cooling fluids to flow in opposing directions to one another over a substantial portion of the core. This method of getting flow into and out of a counterflow heat exchanger optimizes heat transfer for a given amount of heat transfer surface area by ensuring that all fluid flow paths have essentially the same length, achieving essentially uniform flow through each flow passage of the heat exchanger. As shown in FIGS. 1*a* and 1*b* the prior art consists of a single counterflow section 20 with one tent section 24 at each end of the counterflow section 20. The tent sections 24 are comprised of multiple tent flow channels.

Figure 3A:
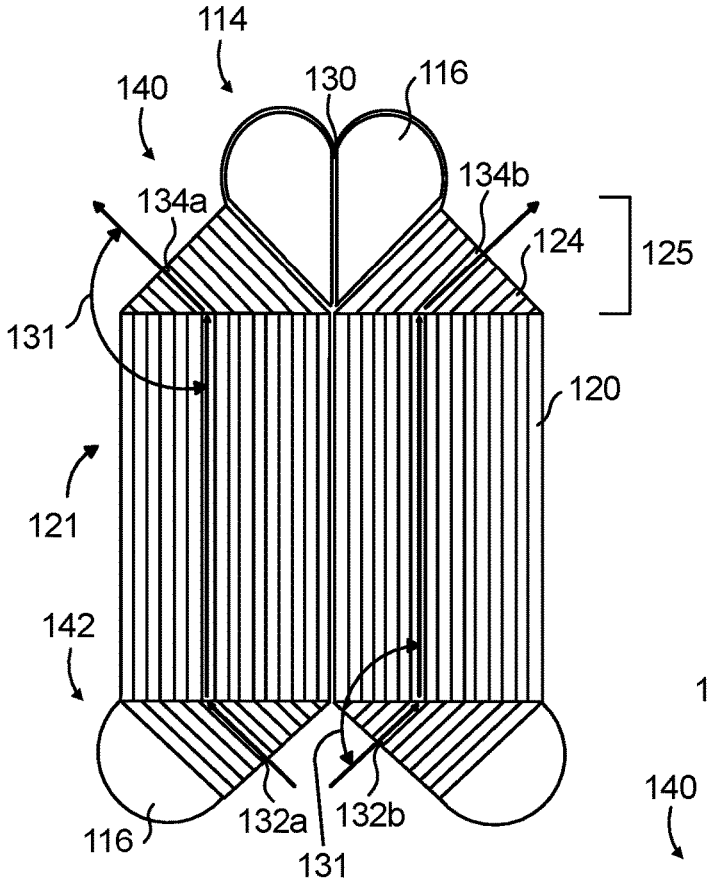
FIG. 3*a* is a cross-sectional view of a second layer plate of FIG. 2, having multiple angled tent sections on both ends of a cold layer of a counterflow core section.
Figure 3B:
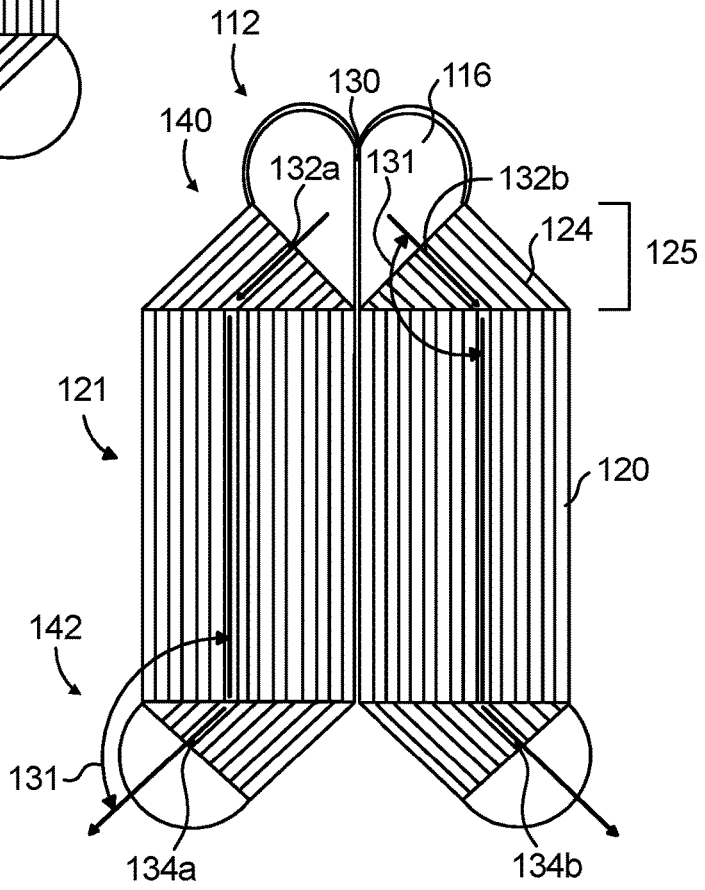
FIG. 3*b* is a cross-sectional view of a first layer plate of FIG. 2, having multiple angled tent sections on both ends of a hot layer of a counterflow core section.

With reference to FIGS. 2-3*b*, the present disclosure includes a heat exchanger 100 having smaller diameter headers containing the highest pressure fluid to minimize header thickness, reducing heat exchanger weight and simplifying the design from a structural standpoint. High pressure heat exchangers often must have a minimum number of fins per unit flow width to contain the high pressures, and this minimum fin density must exist throughout the heat exchanger, i.e., in both the core and tent sections of the heat exchanger.

To maintain practical duct sizes to channel fluid to and from the heat exchanger, a narrow tent section width is desirable; however, because a minimum distance between fins must be maintained throughout the core and tent sections for structural reasons, pressure drop through the tent sections of prior art counterflow heat exchangers is often high, resulting in an undesirably large heat exchanger volume and weight. The reduced flow length of multiple tent sections in a heat exchanger plate, as well as the reduction in the amount of total fluid flow passing through each tent section results in reduced pressure drop in the tent sections relative to the pressure drop in the tent sections of prior art heat exchangers, With continued reference to FIG. 2 a perspective view of the heat exchanger 100 of the present disclosure is shown. The heat exchanger 100 includes a plurality of heat exchanger plates in a stacked arrangement. Each heat exchanger plate include a first layer 114 (i.e, a cold layer) with cold fluid flowing therethrough and a second layer 112 (i.e., a hot layer) with a hot fluid flowing therethrough. The plates are stacked to form a core of the heat exchanger. The hot and cold layers are physically separated by a parting sheet (not shown). The fluid flow passages in the hot and cold layers 112, 114 are arranged such that the hot fluid flowing through the hot layer is configured to exchange heat between the cooling fluid flowing through the cold layer. As shown in FIGS. 3*a*-3*b*, counterflow sections 120 comprise an intermediate portion of heat exchange plates where the heat exchange occurs. In contrast to the prior art design shown in FIGS. 1*a* and 1*b*, each layer 112, 114 of the heat exchanger includes multiple counterflow sections 120 positioned adjacent each other with multiple tent sections 124 on each end. The tents sections 124 of heat exchanger 100 are relatively shorter in length than those shown in prior art 10 which reduces pressure drop for a given rate of fluid flow through the tent sections 124. With continued references to FIGS. 3*a*-3*b*, on one end of each layer 112, 114 the tent sections 124 share a header 116 and on an opposing end each tent section 124 has an individual header section 116. When the plates are stacked into a core, the individual headers 116 combine to form continuous flow paths to channel hot and cooling fluid to and from the heat exchanger core. Two tent sections sharing a single header reduces the number of headers needed and therefore reduces weight and cost of the heat exchanger relative to the prior art. A solid wall 130 is positioned between the tent sections 124 and continues adjacent the counterflow core sections 120 for each layer 112, 114.

Each of the layers 112, 114 includes inlet ports 132*a*, 132*b* within respective tent sections 124 configured to allow the respective fluid to enter the counterflow section 120 and two outlet ports 134*a*, 134*b* within respective tent sections 124 configured to allow the respective fluid to exit the counterflow section 120. As shown in FIG. 3*a*, the cold layer 114 includes two inlet ports 132*a* and 132*b* at one end of the heat exchanger plate (i.e. a first end) 142 where the inlet ports 132*a*, 132*b* are positioned along a surface of the respective tent 124. The cooling fluid enters and flows through the counterflow section 120 and then exits outlet ports 134*a* and 134*b* at the opposing end (i.e. a second end) 140 along a surface of the respective tent 124. As shown in FIG. 3*b*, the hot layer 112 includes two inlet ports 132*a* and 132*b* through respective tents 124 and header 116 at the second end 140. The hot fluid flows through the counterflow section 120, in the opposite direction of the cold fluid, and exits outlet ports 134*a* and 134*b* at the first end 142 through respective tents 124 and headers 116. It will be understood by those skilled in the art that while the flow directions are shown in a specific configuration in FIGS. 3*a* and 3*b*, the flow directions can be changed between the hot and cold layers without departing from the scope of the present disclosure. In further embodiments, the flow directions can be swapped such that the fluid enters at the outer ends and exits near the center.

The inlet and outlet ports 132*a*, 132*b*, 134*a*, 134*b* are aligned facing away from each other and directing the respective fluid into the respective counterflow sections 120. The wall 130 is continuous along the entire counterflow sections 120 (in the direction of the stacked layers) to hold the high pressure headers 16 on the heat exchanger 100. The wall 130 allows the pressure forces acting on the high pressure headers 116 on one end to react against the forces on the high pressure headers on the other end. This allows the effective diameter of each half of the header to be decreased, allowing the required header hoop stress to be met with reduced thickness and weight.

Figure 4:
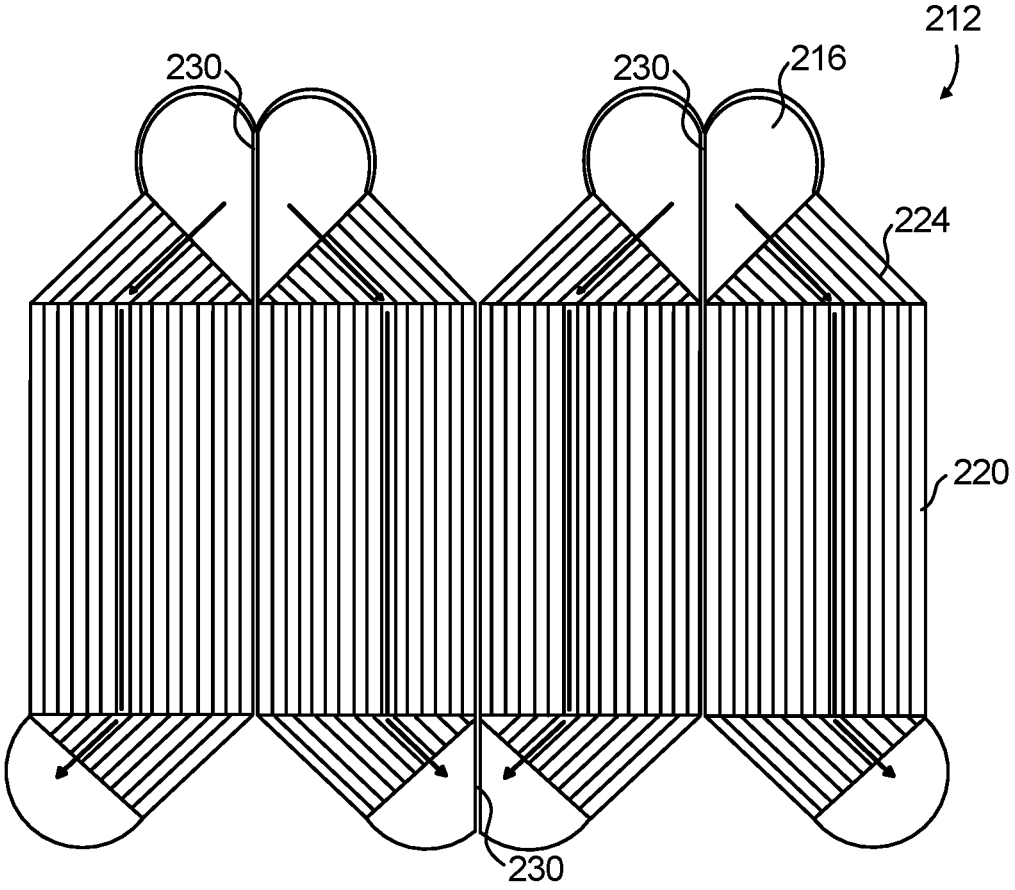
FIG. 4 is an alternate embodiment of a single first or second hot and cold layer of a heat exchanger constructed in accordance with the present disclosure, with a tent section on each end of each core section.

FIG. 4, illustrates a further embodiment of a counterflow heat exchanger. FIG. 4 shows a hot layer 212 but it will be understood that a cold layer will include similar structure in keeping with the disclosure. As shown in FIG. 4, four counterflow sections 220 are positioned adjacent each other. With the combination of additional counterflow sections 220, an additional header 216 combines two tents 224. Three walls 230 are positioned between each of the counterflow sections 220. As the number of counterflow sections increases, the tents 124 of heat exchanger decrease in length and are relatively shorter in length than as in the embodiment of FIGS. 3*a* and 3*b*. As described above, this also reduces flow through the tents which reduces the pressure drop of the tents relative to the pressure drop of the tents of a prior art device with only one tent section on each end of the counterflow section.

The methods and systems of the present disclosure, as described above and shown in the drawings, provide for counterflow heat exchanger with superior properties including reducing tent length and fin density. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A heat exchanger, comprising:

a plurality of heat exchanger plates in a stacked arrangement;

at least two counterflow sections positioned laterally adjacent one another, the at least two counterflow sections comprising an intermediate section of each of the plurality of heat exchanger plates, the heat exchanger plates configured to transfer heat between a first fluid flowing in a first fluid path and a second fluid flowing in a second fluid path in opposite directions from one another through respective heat exchanger plates;

a first tent section provided on and in fluid communication with a first end of each of the at least two counterflow sections, and a second tent section provided on and in fluid communication with a second end of each of the at least two counterflow sections, each of the first and second tent sections configured to angle the flow direction of the first and second fluids relative to the flow direction in the at least two counterflow sections;

a first header section connected to each first tent section, adapted and configured to distribute fluid to the first fluid path;

a second header section connected to each second tent section, adapted and configured to distribute fluid from the first fluid path; and a reinforcing wall disposed between the at least two counterflow sections, extending longitudinally into and connecting to one of the first header section and the second header section, thereby reinforcing the respective header section, by providing a load path to oppose forces due to pressure on the respective header section.

2. The heat exchanger of claim 1, further comprising at least two primary inlet ports configured to allow the first fluid to enter the first fluid path of the heat exchanger and at least two primary outlet ports configured to allow the first fluid to exit the first fluid path of heat exchanger, each primary inlet port and primary outlet port positioned through a respective tent.

3. The heat exchanger of claim 2, wherein the inlet ports of the first fluid are separated by the reinforcing wall and wherein the outlet ports of the first fluid are separated by the reinforcing wall.

4. The heat exchanger of claim 2, further comprising at least two secondary inlet ports configured to allow the second fluid to enter the heat exchanger and at least two secondary outlet ports configured to allow the second fluid to exit the heat exchanger, each secondary inlet port and secondary outlet port positioned through a respective tent.

5. The heat exchanger of claim 4, wherein the secondary inlet ports of the second fluid are separated by the reinforcing wall and wherein the secondary outlet ports of the second fluid are separated by the reinforcing wall.

6. The heat exchanger of claim 5, wherein the primary inlet ports for the first fluid are on an opposing end of the secondary inlet ports for the second fluid and wherein the primary outlet ports for the first fluid are on an opposing end of the secondary outlet ports for the second fluid.

7. The heat exchanger of claim 6, wherein the first fluid includes a cooling fluid and the second fluid is configured to transfer heat to the first fluid within the at least two counterflow sections.

8. The heat exchanger of claim 7, wherein each of the plurality of heat exchanger plates is comprised of a first layer for the first fluid and a second layer for the second fluid to flow therethrough, the first and second layers being positioned adjacent within the stacked arrangement of heat exchanger.

9. The heat exchanger of claim 1, wherein each of the plurality of heat exchanger plates includes a cold layer with the first fluid flowing therethrough, the first fluid including a cooling fluid, the cold layer having primary inlet ports through the first tent section and primary outlet ports through the second tent section.

10. The heat exchanger of claim 9, wherein the primary inlet ports of adjacent first tent sections are aligned leading away from one another, such that the first fluid entering the primary inlet ports is separated through the counterflow section.

11. The heat exchanger of claim 9, wherein each of the plurality of heat exchanger plates includes a hot layer with the second fluid flowing therethrough, the second fluid configured to transfer heat from the cooling fluid, the hot layer having secondary inlet ports through the second tent section and secondary outlet ports through the first tent section.

12. The heat exchanger of claim 11, wherein the secondary inlet ports of adjacent second tent sections are aligned leading away from one another, such that the second fluid entering the secondary inlet ports is separated through the counterflow section.

13. The heat exchanger of claim 1, wherein at one of the first and second ends of the at least two counterflow sections, each tent includes its own header and wherein at an opposing end of the counterflow sections, two tents share a single header separated by the reinforcing wall.

14. The heat exchanger of claim 1, comprising four counterflow sections and a reinforcing wall separating each counterflow section.

15. The heat exchanger of claim 1, wherein the reinforcing wall extends continuously from at least one header section on each of the plurality of heat exchanger plates along the entire length of the at least two counterflow sections.

* * * * *